US009919358B2

(12) United States Patent
Gries

(10) Patent No.: US 9,919,358 B2
(45) Date of Patent: Mar. 20, 2018

(54) SINTERED MOLYBDENUM CARBIDE-BASED SPRAY POWDER

(71) Applicant: H.C. STARCK GMBH, Goslar (DE)

(72) Inventor: Benno Gries, Wolfenbuettel (DE)

(73) Assignee: H.C. STARCK GMBH, Goslar (DE)

( * ) Notice: Subject to any disclaimer, the term of this patent is extended or adjusted under 35 U.S.C. 154(b) by 0 days.

(21) Appl. No.: 15/026,603

(22) PCT Filed: Oct. 1, 2014

(86) PCT No.: PCT/EP2014/071080
§ 371 (c)(1),
(2) Date: Apr. 1, 2016

(87) PCT Pub. No.: WO2015/049309
PCT Pub. Date: Apr. 9, 2015

(65) Prior Publication Data

US 2016/0243616 A1 Aug. 25, 2016

(30) Foreign Application Priority Data

Oct. 2, 2013 (DE) ..... 10 2013 220 040

(51) Int. Cl.
*B22F 1/00* (2006.01)
*C23C 4/06* (2016.01)
(Continued)

(52) U.S. Cl.
CPC ..... *B22F 1/0062* (2013.01); *B22F 1/0003* (2013.01); *B22F 9/04* (2013.01);
(Continued)

(58) Field of Classification Search
None
See application file for complete search history.

(56) References Cited

U.S. PATENT DOCUMENTS 4,597,939 A 7/1986 Neuhäuser et al.
4,756,841 A * 7/1988 Buran ..... C23C 4/06 508/150
(Continued)

FOREIGN PATENT DOCUMENTS

DE 28 41 552 A1 3/1980
DE 696 05 270 T2 4/2000
(Continued)

OTHER PUBLICATIONS

ASTM G 65-04: "Standard Test Method for Measuring Abrasion Using the Dry Sand/Rubber Wheel Apparatus", pp. 1-12 (2004).
(Continued)

*Primary Examiner* — Jessee R Roe
*Assistant Examiner* — Ngoclan T Mai
(74) *Attorney, Agent, or Firm* — Norman B. Thot

(57) ABSTRACT

A sintered spray powder includes from 5 to 50 wt.-% of a metallic matrix, from 50 to 95 wt.-% of a hard material, and from 0 to 10 wt.-% of a wear-modifying oxide, each based on the total weight of the sintered spray powder. The metallic matrix comprises from 0 to 20 wt.-% of molybdenum based on the total weight of the metallic matrix. The hard material comprises at least 70 wt.-% of molybdenum carbide based on the total weight of the hard material. An average particle diameter of the molybdenum carbide in the sintered spray powder is <10 μm, determined in accordance with ASTM E112.

14 Claims, 2 Drawing Sheets

(51) Int. Cl.

| | |
|---|---|
| ***C22C 29/06*** | (2006.01) |
| ***B22F 9/04*** | (2006.01) |
| *C23C 4/129* | (2016.01) |
| *C23C 4/134* | (2016.01) |

(52) U.S. Cl.
CPC ..... *C22C 29/06* (2013.01); *C22C 29/067* (2013.01); *C23C 4/06* (2013.01); *B22F 2301/20* (2013.01); *B22F 2302/10* (2013.01); *B22F 2302/25* (2013.01); *C23C 4/129* (2016.01); *C23C 4/134* (2016.01)

(56) References Cited

U.S. PATENT DOCUMENTS

| | | | | |
|---|---|---|---|---|
| 5,603,076 | A | 2/1997 | Sampath | |
| 5,641,580 | A | 6/1997 | Sampath et al. | |
| 2010/0047622 | A1* | 2/2010 | Fischer | C22C 29/02 428/698 |
| 2010/0077887 | A1 | 4/2010 | Schrumpf et al. | |
| 2011/0254230 | A1 | 10/2011 | Jarosinski et al. | |
| 2014/0234548 | A1 | 8/2014 | Zimmermann et al. | |

FOREIGN PATENT DOCUMENTS

| | | | |
|---|---|---|---|
| DE | 10 2007 004 937 | A1 | 7/2008 |
| DE | 10 2011 112 435 | B3 | 10/2012 |
| EP | 0 009 210 | A2 | 4/1980 |
| EP | 0 114 232 | A1 | 8/1984 |
| EP | 0 701 005 | A1 | 3/1996 |
| WO | WO 2008/034902 | A1 | 3/2008 |

OTHER PUBLICATIONS

DIN 66137-3: "Determination of solid state density—Part 3: Gas buoyancy method", English Translation, pp. 1-11 (2005).
DIN EN 1274: "Thermal spraying: Powders, Composition, technical supply conditions", English version of DIN EN 1274, pp. 1-21 (2005).
ASTM B330-12: "Standard Test Methods for Estimating Average Particle Size of Metal Powders and Related Compounds Using Air Permeability", pp. 1-7 (2012).
ASTM E112-12: "Standard Test Methods for Determining Average Grain Size", pp. 1-27 (2013).
ASTM B 822-97: "Standard Test Method for Particle Size Distribution of Metal Powders and Related Compounds by Light Scattering", pp. 1-3 (1997).
ASTM B212-13: "Standard Test Method for Apparent Density of Free-Flowing Metal Powders Using the Hall Flowmeter Funnel", pp. 1-4 (2013).
ASTM B117-11: "Standard Practice for Operating Salt Spray (Fog) Apparatus", pp. 1-12 (2011).
P. A. Webb: "Volume and Density Determinations for Particle Technologists", Micromeritics Instrument Corp., Feb. 16, 2001, pp. 1-16 (2001).
V. A. Hackley: "The Use of Nomenclature in Dispersion Science and Technology", Special Publication 960-3, pp. 1-71 (2001).

* cited by examiner

SINTERED MOLYBDENUM CARBIDE-BASED SPRAY POWDER

CROSS REFERENCE TO PRIOR APPLICATIONS

This application is a U.S. National Phase application under 35 U.S.C. § 371 of International Application No. PCT/EP2014/071080, filed on Oct. 1, 2014 and which claims benefit to German Patent Application No. 10 2013 220 040.4, filed on Oct. 2, 2013. The International Application was published in German on Apr. 9, 2015 as WO 2015/049309 A1 under PCT Article 21(2).

FIELD

The present invention relates to a sintered spray powder obtainable using molybdenum carbides, a process for producing the sintered spray powder, as well as the use of the sintered spray powder to coat components, especially moving components. The present invention also describes a process for applying a coating using the sintered spray powder of the present invention and a component coated therewith.

BACKGROUND

Spray powders are used to produce coatings on substrates by means of "thermal spraying". In this process, pulverulent particles are injected into a combustion flame or plasma flame which is directed onto a (usually metallic) substrate which is to be coated. The particles here melt completely or partially in the flame, impinge on the substrate, solidify there, and form the coating in the form of solidified "splats". In contrast, in cold gas spraying, the particles melt only on impingement on the substrate to be coated as a result of the kinetic energy set free. It is possible to produce coatings having a layer thickness of several μm up to several mm by thermal spraying.

A frequent application of spray powders is the production of wear protection layers. These comprise, both in the case of the layers as well as in the case of the powders, typically cermet powders, which are distinguished in that they firstly contain a hard material (this is the ceramic component, "cer-"), most frequently carbides such as tungsten carbide, chromium carbide, and more rarely, other carbides, and secondly, a metallic component as metallic matrix ("-met") which consists of metals such as cobalt, nickel and alloys thereof with chromium, more rarely also iron-comprising alloys. Such spray powders and sprayed layers produced therefrom are thus classic composites. Such spray powders are also known to those skilled in the art as "agglomerated/sintered" spray powders, i.e., agglomeration (also referred to as pelletization) is firstly carried out in the production process and the agglomerate is then internally thermally sintered in itself in order to give the agglomerates the mechanical stability necessary for thermal spraying. However, those spray powders which are produced by sintering of powder mixtures or pressed bodies followed by a comminution step also meet the necessary prerequisites. These types of spray powders are known to those skilled in the art as "sintered/crushed". The two abovementioned types of spray powders are, for example, typified by the standard DIN EN 1274:2005. Both classes of powder are also described as "sintered spray powders".

Sintered/crushed spray powders are produced in a manner analogous to agglomerated/sintered powders with the exception that the powder components must not necessarily be mixed wet in dispersion, but can be mixed dry and optionally tableted or compacted to provide shaped bodies. The subsequent sintering is carried out analogously, however, compact, solid sintered bodies are obtained which must then be converted back into powder form by mechanical force. The powders thereby obtained have an irregular shape and are characterized by fracture processes on the surface. These spray powders have significantly poorer flowability, which is disadvantageous for a constant deposition efficiency (deposition rate) in thermal spraying.

Coatings can be characterized by empirically determinable materials properties in a manner analogous to solid materials. These include hardness (for example, Vickers, Brinell, Rockwell, and Knoop hardness), wear resistance (for example, in accordance with ASTM G65), cavitation resistance, and friction behavior, but also the corrosion behavior in various media and density, in particular true density. In the case of coatings formed by cermets, the materials properties are determined by the proportion and degree of distribution of the metallic phase and the ceramic or hard material phase. The fundamental relationships therefor are familiar to those skilled in the art. One of these relationships is the Hall-Petch law. This law establishes the connection between the degree of dispersion of the ceramic phase and various materials properties. It follows that the ceramic or hard phase should be dispersed as finely as possible in the metallic phase if high strength and high hardness are to be achieved. For this purpose, the metallic phase must have a preferably complete contiguity. This means that it forms a complete three-dimensional network in the mesh gaps of which the hard material particles are embedded and thus separated from one another.

For some applications, a low true density of coatings with cermets, particularly in the case of moving, in particular rotating and/or flying components, can be advantageous. The geometric density of a coating is here close to the true density, which is calculated from the volume-weighted proportions of the components (e.g., the hard materials, the metallic matrix, and potential oxidation products), and their true densities. The true density can, for example, be determined on full-density coatings after detachment thereof via of the Archimedes method. The true density of pulverulent coating materials can be determined as pure density, for example, as skeleton density, via pycnometry, in particular via helium pycnometry (DIN 66137), with the measured values being very close to the true density in the case of "completely" open-pore powders. Under ideal conditions, the value for the true density of single-phase powders or bodies is identical to the density determined by the X-ray method.

To obtain the necessary polishability of coatings in order to achieve very low roughnesses, as is necessary in the case of tribologically stressed layers, the hard materials present in the coating must have a sufficiently good distribution in the metallic matrix and have a small size. It follows therefrom that the metallic matrix should also have a web width (ridge width) which is of the same order of magnitude as is likewise necessary for polishability. A low web width of the metallic matrix leads, in the case of cermet powders, to a low elongation at break, which improves polishability.

The web width of the metallic matrix is defined as the average distance between neighboring hard material particles in the coating which is filled with the metallic matrix. The greater this web width, the greater the maximum absolute elongation at break, and the greater the deformed regions and thus also the roughness in the polishing operation.

It is clear therefrom why thermal spraying of powder mixtures (known as "blends") is not advantageous: the powders used must have a certain minimum size, i.e., because of the turbulences in the flame, which typically lies in an average particle size range of from 15 to 100 μm. This results, however, in the coating having a heterogeneous texture ("spot landscape") made up of the powder types used. The consequence is that matrix and hard material are not dispersed in the μm scale, with adverse consequences for polishability. Typical examples of a blend of agglomerated/sintered $Mo/Mo_2C$ with an alloy powder may be found in the patent EP 0 701 005 B1. Coatings having a lamellar microstructure result from the use of NiCrFeBSi alloy powder as a metallic matrix, which does not contain any hard materials, and therefore produces the hard material-free, metallic lamellae described. The material's advantages which would result from a high degree of dispersion of the metallic phase in the hard material therefore cannot be achieved by a blend.

The chemical state of the surface is important for the mixed friction region according to Stribeck. Soft oxides as surface species, which can be detected, for example, by surface-analytical methods, are advantageous. These are advantageously soft layer lattice oxides such as $B_2O_3$, $WO_3$, or $MoO_3$, and the hydration acids thereof. These have, for example, a strong, positive influence on the break-off moment after long inactivity of the friction pairing, as can occur, in particular, in the case of hydraulic piston rods or else in the case of piston rings.

A coating used in the prior art is electrochemically produced hard chromium. A disadvantage thereof is the strongly environment-polluting production from hexavalent chromium, which is classified as a carcinogenic. An advantage is the very low coefficient of friction (μ). Additional disadvantages are tensile stresses and cracks resulting therefrom which do not produce effective corrosion protection of the substrate. The coating which is under tensile stress also represents a weakening of the substrate in respect of its mechanical cycling strength (fatigue). The cracks also sometimes transport hydraulic oil containing toxic constituents such as ethyleneamine into the environment when a piston rod is taken out. Hard chromium has virtually no elongation at break and is therefore readily polishable (to an average peak-to-valley height (scallop) of 0.1 μm), but is brittle in the case of mechanical shock. The wear resistance tends to be moderate because of a lack of hard materials. The geometric density is comparatively low at about 7 g/cm$^3$. It is thus below the true density of metallic chromium (7.19 g/cm$^3$). The cause therefor is pores and cracks.

Fusible materials based on Ni or Co—CrFeBSi (for compositions, see, for example, DIN EN 1274:2005, Table 2) display extraordinarily dense, i.e., relatively nonporous, layers. After melting of the initially porous sprayed layer, very hard but also very brittle CrB precipitates are obtained. Fusible materials display a very low coefficient of friction, presumably due to the boron trioxide present on the surface which is known to have good properties as a solid lubricant. The fusible materials also display very good polishing behavior, but have little wear resistance because of the very low elongation at break (similar to the case of hard chromium). They are therefore often processed in an admixture (as a blend) with other hard material-containing spray powders, e.g., with WCCo 88/12 or 83/17, or else with metallic molybdenum which often contains $Mo_2C$ precipitates, or even with pure molybdenum carbide spray powders. The latter coatings have previously been described, often with a third component such as CrC—NiCr, on, for example, piston rings in internal combustion engines. They do not, however, have a uniform distribution of the hard phases in the range below 10 μm, but instead tend to be present in the coating as a spot landscape comprising various materials. These different materials are then present in the layer as regions having a size in the order of that of the spray powders used (which typically have 45-10 μm as indicated grain size range) so that when stressed by foreign bodies in the micron range, the coating behaves in a manner corresponding to its local composition. They are therefore not advantageous, in particular where the intrusion of foreign bodies into the tribological friction pairing must be expected. The true density of the pure fusible alloys is in the order of about 8 g/cm$^3$, but in admixture with other spray powders slightly higher, depending on which other spray powders are mixed in.

Very high-quality coatings are those based on tungsten carbide, for example WCCo 83/17 or WC—CoCr 86/10/4. The friction behavior is advantageous due to the presence of tungstic acid or tungsten trioxide as a solid lubricant on the surface of the coating. The wear resistance is high and the layers can be produced to be pore-free, i.e., the density of the coating is in the vicinity of the true density, under suitable conditions, and have a low elongation at break. The polishability is very good because of the finely dispersed metallic matrix (Co or CoCr, alloyed with W). Layers which are under an internal compressive stress can in particular be produced, which is important for the fatigue strength of the substrate under alternating mechanical stress. Disadvantages are the very high true density of these coating materials and the resulting high geometric densities, typically up to about 14 g/cm$^3$, the somewhat higher coefficient of friction compared to hard chromium, and the high raw materials costs for tungsten. The high geometric densities on rotating and flying components lead to an increased energy consumption due to the increased moment of inertia or the greater flying weight.

A further alternative is provided by Cr— and chromium carbide-containing alloys, in particular those based on iron and nickel, and cermet spray powders such as CrC—NiCr 75/25. Common to all these is the formation of chromium oxide ($Cr_2O_3$) on thermal spraying. This oxide is harder than metallic friction partners and scores these, but has low coefficients of friction against metallic materials. These oxide precipitates also act as predefined points of fracture of the ductile metallic matrix and reduce its elongation at break, and are thus not a priori detrimental. The self-lubricating effect due to soft oxides, which can be significant in the field of mixed friction, is absent. The true density is comparatively low and is about 7.3 g/cm$^3$. The wear strength of these coatings is comparatively low and not satisfactory for many applications.

SUMMARY

An aspect of the present invention is to provide a coating which overcomes the disadvantages of the prior art. The coating should in particular be a composite (composite material) which has a true density of less than 10 g/cm$^3$, and has finely divided hard materials having an average size of not more than 10 μm with an advantageous friction behavior in a narrow-webbed and finely dispersed metallic matrix, coupled with a low true density.

In an embodiment, the present invention provides a sintered spray powder which includes from 5 to 50 wt.-% of a metallic matrix, from 50 to 95 wt.-% of a hard material, and from 0 to 10 wt.-% of a wear-modifying oxide, each based on the total weight of the sintered spray powder. The metallic matrix comprises from 0 to 20 wt.-% of molybdenum based on the total weight of the metallic matrix. The hard material comprises at least 70 wt.-% of molybdenum carbide based on the total weight of the hard material. An average particle diameter of the molybdenum carbide in the sintered spray powder is <10 μm, determined in accordance with ASTM E112.

BRIEF DESCRIPTION OF THE DRAWINGS

The present invention is described in greater detail below on the basis of embodiments and of the drawings in which.

DETAILED DESCRIPTION

Figure 1:
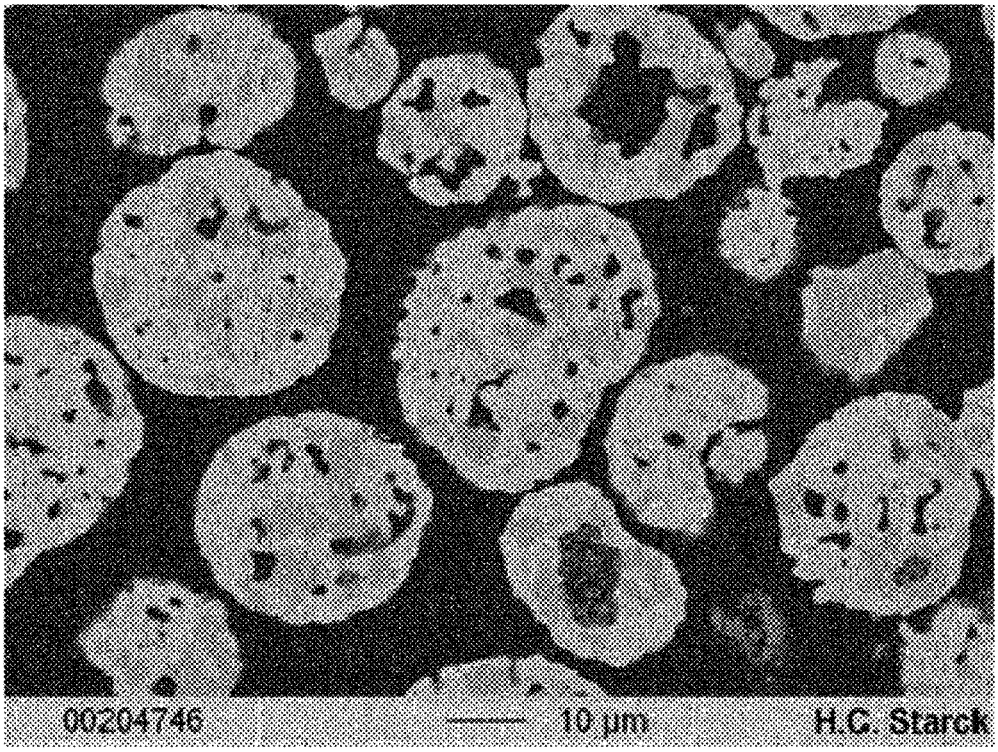
FIG. 1 shows an electron micrograph of a polished powder specimen of the present invention (back-scattered electrons)

The present invention provides a sintered spray powder which comprises the following components:

a) from 5 to 50 wt.-% of metallic matrix, based on the total weight of the spray powder, wherein the matrix contains from 0 to 20 wt.-% of molybdenum, for example, from >0 wt.-% to 20 wt.-%, for example, from 0.1 to 20 wt.-%, based on the total weight of the metallic matrix;

b) from 50 to 95 wt.-% of hard materials, based on the total weight of the spray powder, consisting of or comprising at least 70 wt.-% of molybdenum carbide based on the total weight of the hard material, wherein the average diameter of the molybdenum carbide in the sintered spray powder is <10 μm, in particular <5 μm; and c) optionally wear-modifying oxides.

The average diameter of the molybdenum carbide was determined in accordance with the standard ASTM B330 ("FSSS" Fisher Sub Sieve Sizer).

The percent by weight (wt.-%) figures in respect of the powder and mixtures according to the present invention in each case add up to 100 wt.-%.

Suitable wear-modifying oxides for the purposes of the present invention are those which are sufficiently stable under the sintering conditions of the spray powder and are not reduced. Owing to their high thermodynamic stability, these oxides are sufficiently hard and have the advantage of having low coefficients of friction against metallic systems. The wear-modifying oxides can, for example, be selected from the group consisting of $Al_2O_3$, $Y_2O_3$, and oxides of the $4^{th}$ transition group (subgroup) of the Periodic Table. The oxides can, for example, be provided as powders having average particle sizes in the range from 10 nm to 10 μm.

In an embodiment of the present invention, the spray powder of the present invention can, for example, comprise wear-modifying oxides, with the amount of wear-reducing oxides being in the range from 0 to 10 wt.-%, for example, from 1 to 8 wt.-%, based on the total weight of the spray powder.

The percent by weight figures add up to 100 wt.-%.

The spray powder of the present invention is sintered, for example, agglomerated and sintered. Such spray powders are also referred to as agglomerated/sintered.

The powders of the present invention can further advantageously be of the sintered/crushed type, for example, the powders of the agglomerated/sintered type as described in DIN EN 1274:2005 can be used.

The basis of the hard material consists of fine-grained molybdenum carbides, for example, MoC and $Mo_2C$. For the purposes of the present invention, "basis" means that at least 70 wt.-% of the corresponding material is present, based on the total weight of the hard material. The remaining maximum 30 wt.-% of hard materials can be other carbides, for example, chromium carbides and iron carbides because of their nonvolatile and brittle oxides, or, for example, tungsten carbide and boron carbide whose soft surface oxides have been found to be advantageous. Other carbides from the $4^{th}$ to $6^{th}$ transition group of the Periodic Table can also be used. The choice of suitable carbides will be made by a person skilled in the art on the basis of the surface state of the carbides and the intended use of the coating.

The spray powder contains from 5 to 50 wt.-% of metallic matrix and thus from 95 to 50 wt.-% of hard materials, of which molybdenum carbides make up at least 70 wt.-%. The spray powder thus contains from 95 to 35 wt.-% of molybdenum carbides, with these being fine-grained (<10 μm in accordance with ASTM B330, measured on the powder used for spray powder production).

The figures in percent by weight (wt.-%) in respect of the powders and mixtures in the present invention in each case add up to 100 wt.-%.

The average particle diameter of the molybdenum carbide in the sintered spray powder can, for example, be less than 10 μm, for example, from 0.5 to 6.0 μm, in particular from 0.5 to 4.0 μm, for example, from 0.5 to 2.0 μm, from 1.0 to 6.0 μm, or from 1.0 to 4.0 μm, determined in accordance with ASTM E112. Improving the wear resistance is here effected at the expense of ductility and vice versa; the range therefore depends on the respective application, depending on whether a higher wear resistance or a higher ductility is required. As a specific compromise of these two properties, the range from 1.0 to 6.0 μm constitutes an optimum range for most applications. Since the determination of the particle sizes in the powder used for spray powder production is carried out by a different method (ASTM B330) than the determination of the particle sizes in the sintered spray powder (ASTM E112), the particle sizes obtained in this way cannot be directly compared with one another. Particle growth is, however, usually observed in course of sintering so that the actual particle sizes in the sintered spray powder are greater than those in the powder used for spray powder production.

It has in particular been found that the finer the molybdenum carbide powder used (i.e., the smaller the grain size of the molybdenum carbide powder used in accordance with ASTM B330), the better the dispersion of the metallic matrix and its average web width resulting in the spray powder. For the purposes of the present invention, the particle diameter or diameter is the maximum extent of a particle, namely, the dimensions from one edge of the particle to the edge of the particle which is furthest away from this first edge. A particle size of less than 10 μm results in an advantageous deposition efficiency of the powder during spraying and improved adhesion being achieved. In turn, the better adhesion results in the spray loss ("overspray") being minimized and a hazard to health thereby being reduced.

It has been found that the content of metallic matrix is no longer sufficient to provide the metallic properties of the composite in the case of less than 5 wt.-% of metallic matrix, based on the total weight of the spray powder. The wear resistance decreases in the case of more than 50 wt.-% to such an extent that the wear-resistant cermet character of the composite is no longer present. The elongation at break also increases to such an extent that the increase is at the expense of the polishability.

The elongation at break of the sprayed layer can be reduced by the presence of embrittling elements, in particular boron and/or silicon, to such an extent that undesirable crack formation can occur on cooling after thermal spraying. On the other hand, a certain content of these elements can be advantageous for polishability.

In an embodiment of the present invention, boron can, for example, be present in an amount of not more than 1.4 wt.-%, for example, from 0.001 to 1.0 wt.-%, based on the total weight of the metallic matrix.

The figures in percent by weight (wt.-%) for the powders and mixtures in the present invention add up to 100 wt.-% in each case.

In an embodiment of the present invention, silicon can, for example, be present in an amount of not more than 2.4 wt.-%, for example, from 0.001 to 2.0 wt.-%, based on the total weight of the metallic matrix.

The figures in percent by weight (wt.-%) for the powders and mixtures in the present invention add up in each case to 100 wt.-%.

It can be established whether and what amounts of refractory metal borides and silicides are precipitatable via the content of boron and silicon in the spray powder of the present invention, for example, together with the content of refractory metals. These refractory metal borides and silicides likewise have advantageous tribological properties. The contents of boron, silicon, and refractory metal can also be prescribed as per the respective requirements by the principle of the solubility product. For the purposes of the present invention, refractory metals are, in particular, the high-melting, ignoble (base) metals of the fourth, fifth and sixth transition group, in particular, titanium, zirconium, hafnium, vanadium, niobium, tantalum, chromium, molybdenum, and tungsten. The melting point of these metals is, for example, above 1772° C.

It has been found that the use of molybdenum carbide can be advantageous, especially in aerospace applications. In an embodiment of the present invention, molybdenum carbide with the structure MoC or $Mo_2C$ can, for example, be used.

The properties of the spray powder and consequently the properties of the later coating can, for example, be influenced by the addition of further carbides. In an embodiment of the present invention, the hard material can, for example, comprise further carbides, for example, carbides selected from the group consisting of tungsten carbide, chromium carbides, and boron carbide. The carbide can, for example, be a carbide of a metal selected from the metals of the $4^{th}$, $5^{th}$ and $6^{th}$ transition groups of the Periodic Table.

In an embodiment of the present invention, the metallic matrix can, for example, contain at least 60 wt.-%, for example, from 70 to 90 wt.-%, of a metal selected from the group consisting of iron, cobalt, and nickel, wherein the percentages are based on the total weight of the metallic matrix. These metals wet the carbides and thus improve the internal cohesion of the composite in the spray powder after sintering as well as in the sprayed layer. The figures in percent by weight (wt.-%) for the powder and mixtures in the present invention in each case add up to 100 wt.-%.

The metallic matrix can, for example, also comprise elements which reduce the elongation at break of the metallic matrix and have a strengthening effect. These elongation at break reductors and elements that have a strengthening effect can, for example, be selected from the group consisting of molybdenum, tungsten, boron, silicon, chromium, niobium, and manganese, as well as combinations/mixtures thereof. The amount of elongation at break reductors and elements that have a strengthening effect in the metallic matrix can, for example, be less than 40 wt.-%, for example, from 5 to 20 wt.-%, based on the total weight of the metallic matrix.

The figures in percent by weight (wt.-%) for the powders and mixtures in the present invention in each case add up to 100 wt.-%.

In an embodiment of the present invention, the metallic matrix can, for example, comprise nickel in an amount of from 50 wt.-% to 95 wt.-%, for example, from 60 wt.-% to 85 wt.-%, based on the total weight of the metallic matrix. The presence of nickel can lead to the formation of intermetallic compounds, as a result of which the metallic matrix is likewise strengthened.

The figures in percent by weight (wt.-%) for the powders and mixtures in the present invention in each case add up to 100 wt.-%.

The metallic matrix can, for example, comprise cobalt in an amount of from 10 to 90 wt.-%, for example, from 20 to 90 wt.-%, in particular from 50 to 90 wt.-%, based on the total weight of the metallic matrix.

The figures in percent by weight (wt.-%) for the powders and mixtures in the present invention in each case add up to 100 wt.-%.

In an embodiment of the present invention, the metallic matrix can, for example, comprise iron in an amount of from 10 to 90 wt.-%, for example, from 20 to 60 wt.-%, in particular from 20 to 50 wt.-%, based on the total weight of the metallic matrix.

The figures in percent by weight (wt.-%) for the powders and mixtures in the present invention in each case add up to 100 wt.-%.

In an embodiment of the present invention, the metallic matrix can, for example, comprise molybdenum in an amount of from 2 to 15 wt.-%, for example, from 5 to 10 wt.-%, based on the total weight of the metallic matrix.

The figures in percent by weight (wt.-%) for the powders and mixtures in the present invention in each case add up to 100 wt.-%.

In an embodiment of the present invention, the components of the metallic matrix can, for example, be provided exclusively or partially by means of one or more alloy powders. The narrow-webbed nature of the metallic matrix in the spray powder and in the coating can here be provided, for example, by intensive milling with the carbides.

Many components, especially those in aerospace applications, are exposed to extreme conditions, for example, large temperature fluctuations as well as erosive wear. A further difficulty is that, owing to the field of use, strict requirements exist with respect to the weight of the components and thus the geometric density and therefore also the true density of the materials used. It has become standard practice to provide strongly stressed components with coatings which protect the components against external influences and thus contribute to a longer life of the components.

The present invention therefore further provides for the use of the spray powder of the present invention for a surface coating.

The sintered spray powder according to the present invention is especially suitable for use in thermal processes. In an embodiment of the present invention, the surface coating can, for example, be carried out by thermal spray processes.

A number of methods are available to a person skilled in the art for application of a coating by means of thermal spray processes, with the choice being made according to the requirements which the coating must meet, for example, its thickness. The powders of the present invention can then be, if necessary, matched to the required processing parameters. Surface coating can, for example, be carried out via a thermal spraying process selected from the group consisting of flame spraying, plasma spraying, HVAF (high-velocity air fuel) spraying, and HVOF (high-velocity oxygen fuel) spraying.

As indicated above, the spray powder of the present invention is characterized by its comparatively low true density and is therefore particularly suitable for the coating of components which have a low weight but are simultaneously exposed to extreme conditions, for example, high temperatures, large temperature fluctuations, weather conditions, and/or particle erosion, and at the same time must have a high wear resistance. The requirements which moving parts, in particular rotating and flying parts, must meet are here particularly high because of the additional mechanical stress. A reduction in flying weight also corresponds to a reduction in fuel requirements or an increase in payload, for example, in the aircraft industry.

For this reason, the spray powder of the present invention can, for example, be used to coat components, particularly for moving, in particular, rotating, components, for example, selected from the group consisting of fan blades, compressor blades, hydraulic piston rods, running gear parts, and guide rails.

In particular in the aircraft industry, a reduction in weight without compromising stability and thus safety is an important aspect in the development of new technologies which must be balanced, in particular, in the light of economic and ecological aspects. In an embodiment of the present invention, the spray powder of the present invention can, for example, be used for coating aircraft components.

The present invention further provides a process for producing the spray powder of the present invention. The process comprises the following steps:

a) provision of a mixture comprising,
   i) hard materials comprising or consisting of molybdenum carbide, wherein the average particle diameter of the molybdenum carbide is <10 μm, in particular <5 μm, determined in accordance with ASTM B330, and
   ii) one or more matrix metal powders, wherein the matrix metal powder(s) comprise(s) from 0 to 20 wt.-% of molybdenum, based on the total weight of the matrix powder(s), and
   iii) optionally wear-modifying oxides, wherein the proportion of the oxides is in the range from 0 to 10 wt.-%, for example, from 1 to 8 wt.-%, based on the total weight of the spray power; and
b) sintering the mixture to provide a sintered powder, for example, a sintered powder of the agglomerated/sintered type.

The figures in percent by weight (wt.-%) for the powders and mixtures in the present invention in each case add up to 100 wt.-%.

For the purposes of the present invention, the term matrix metal powders refers to metal powders which are suitable for forming the metallic matrix according to the present invention.

The wear-modifying oxides can, for example, be selected from the group consisting of $Al_2O_3$, $Y_2O_3$ and oxides of the $4^{th}$ transition group of the Periodic Table.

The fine particle size of the hard materials allows the desired narrow-web nature of the matrix lamellae which form between the particles to be set in a controlled manner. It has been found that the smaller the particle size of the hard materials used, the greater their specific surface area, which leads to a lower film thickness, and thus to a smaller web width of the metallic matrix to be wetted.

It has been found to be particularly advantageous if the powders used are present as a mixture in the form of a dispersion in a liquid during the production process. In an embodiment of the process of the present invention, the mixture can, for example, be provided by a dispersion in which the components i), ii) and iii) are present. Suitable liquids are, for example, water, alcohols, ketones, or hydrocarbons, without the illustrative listing being restricted thereto.

It has also been found that the powders of the present invention display their advantageous properties particularly when they are present as agglomerates. In an embodiment of the present invention, an agglomeration step can, for example, be carried out between steps a) and b) of the process of the present invention. Agglomeration can here be carried out, for example, via spray drying.

In embodiment of the present invention, a temporary organic binder can, for example, be added to the mixture from step a) before the agglomeration step. The organic binder can, for example, be paraffin wax, polyvinyl alcohol, cellulose derivatives, polyethyleneimine, and similar long-chain organic auxiliaries which is removed from the mixture, for example, by vaporization or decomposition, in the further course of the process, for example, during sintering.

The process of the present invention for producing the spray powder of the present invention comprises a process step in which the mixture is sintered. Sintering of the mixture can here, for example, be carried out at temperatures of from 800° C. to 1500° C., for example, from 900° C. to 1300° C. As indicated above, in order to produce agglomerated/sintered powder, sintering is carried out after a preceding agglomeration step. On the other hand, to produce sintered/crushed powder, the sintered body obtained by sintering is subsequently comminuted (broken up).

The hard materials used, for example, molybdenum carbide, can sometimes be oxidized during sintering. In an embodiment of the present invention, sintering of the mixture or agglomerates can, for example, be carried out under nonoxidizing conditions, for example, in the presence of hydrogen and/or inert gases and/or reduced pressure. Sintering can here be carried out in the presence of hydrogen and/or inert gases. Sintering can likewise be carried out in the presence of hydrogen and/or reduced pressure. It is also possible to carry out sintering in the presence of inert gases and/or under reduced pressure. For the purposes of the present invention, inert gases are, for example, noble gases or nitrogen. In an embodiment of the present invention, sintering can, for example, additionally be carried out in the presence of carbon in order to additionally counter possible oxidation reactions of molybdenum carbide by means of the getter properties of carbon.

In order to achieve a very narrow particle size distribution, it has been found to be advantageous to remove undesirable coarse fractions and fine fractions of the sintered powder. In an embodiment of the present invention, the process can, for example, comprise an additional screening step which is carried out after sintering and/or as early as after agglomeration, if recommended.

The use of alloy powders has in particular been found to be advantageous in the production of the spray powders of the present invention. In an embodiment of the present invention, an alloy powder can, for example, be used as a matrix material.

The present invention further provides a process for producing a coated component, wherein the process comprises application of a coating via a thermal spraying of the spray powder of the present invention.

The present invention also provides a coated component obtainable by the process of the present invention. The process here comprises application of a coating by thermal spraying of the spray powder of the present invention, as described in the present invention.

The present invention is illustrated by the following examples.

EXAMPLES

As a matrix metal powders, it is possible to use, for example, cobalt powder "efp" or "hmp" from Umicore (Belgium), nickel powder "T255" from Vale (Great Britain), or carbonyl iron powder "CM" from BASF (Germany). The additives which, as elongation at break reducers or strengthening elements, decrease the elongation at break consist of fine-grained metal or alloy powders, for example, commercial molybdenum powders, atomized alloys such as NiCr 80/20, or pulverized ferroalloys such as ferrochrome, ferromanganese, nickel niobium, ferrosilicon, ferroboron, or nickel boron.

Inventive Example

An agglomerated/sintered spray powder was produced from 70 kg of a molybdenum carbide ($Mo_2C$ 160, H.C. Starck GmbH, Goslar) having an average particle size of 1.6 μm (ASTM B330) as a hard material, and 25 kg of nickel metal powder 255 (from Vale-Inco, Great Britain), as well as 5 kg of molybdenum metal powder (average particle size 2.5 μm, determined in accordance with ASTM B330, H.C. Starck GmbH, Goslar) by dispersing these powders together in a liquid, and agglomerating the mixture by spray drying after addition of polyvinyl alcohol. After screening to remove undesirable coarse and fine fractions, sintering was carried out at 1152° C. under hydrogen in the presence of carbon. This gave an agglomerated/sintered spray powder which, after further screening, had the desired nominal particle size range of 45/15 μm (see 3.3 in DIN EN 1274). The agglomerated/sintered spray powder obtained had the following properties:

Chemical composition (in percent by weight):

Carbon: 4.27 wt.-%

Nickel: 24.9 wt.-%

Oxygen: 0.36 wt.-%

Average particle diameter of the sintered agglomerates according to laser light scattering (determined in accordance with ASTM B822, for example, by a Microtrac S3000): 33 μm Hall Flow (ASTM B212): 18 sec/50 g (1/10 inch funnel)

Apparent density (ASTM B212): 3.87 g/cm$^3$

Pycnometric density (He): 9.02 g/cm$^3$

The X-ray diffraction pattern displays peaks of $Mo_2C$ (nominal carbon content: 5.88 wt.-%) and a face-centered cubic Ni phase which, as a result of molybdenum alloyed therein, has a shift in the main peak by about 1°.

On the basis of the known true densities ($Mo_2C$: 9.18 g/cm$^3$; Ni: 8.9 g/cm$^3$; Mo: 10.2 g/cm$^3$), a true density of 9.15 g/cm$^3$ can be calculated from the weighed-in proportions by weight for the composite. The pycnometrically determined skeleton density of the powder is, presumably due to closed porosity and surface oxides or hydroxides, only slightly below the calculated true density.

FIG. 1 shows an electron micrograph of a polished powder specimen of the present invention (back-scattered electrons). The molybdenum carbide can be seen as light-grey areas and has an average particle size of about 5 μm. The optical evaluation to determine the particle size is carried out by delineation by the dark-grey NiMo phase as well as grain boundaries which represent the former surface of the molybdenum carbide powder particles used in the production process.

Coatings were produced from the spray powder by HVOF spraying (kerosene as fuel, spray gun JP-5000 from Praxair, USA); these coatings had, depending on the spraying conditions selected, the following properties:

Deposition efficiency: 37-45%,

Vickers hardness HV0.3: 920 kg/mm$^2$

Coefficient of friction μ against 100Cr6: 0.85-0.87 (pin-on disk method)

Wear in accordance with ASTM G65 method B: 25 mg=2.8 mm$^3$

Chemical composition (in % by weight): C: 3.46 wt.-%, 0: 0.15 wt.-%

According to X-ray diffraction, the sprayed layer consists of $Mo_2C$ and an Ni-containing face-centered cubic metallic matrix having a very broad main peak which is shifted by about 1.2° to lower diffraction angles, i.e., must contain more alloyed Mo than the spray powder.

The spray powder, as can be seen from a comparison of the oxygen content of the spray powder and the sprayed layer, is self-cleaning since the oxygen content in the sprayed layer is lower than that of the spray powder even though oxidation is to be expected to take place during spraying. A possible explanation would be that volatile $MoO_3$ vaporizes during thermal spraying. This effect can also be assumed in the case of WCCo spray materials in which $WO_3$ vaporizes.

In the salt corrosion test (ASTM B117), good resistance of the sprayed layer to sodium chloride was found.

The coefficient of friction is in the range common for sprayed carbide materials.

Figure 2:
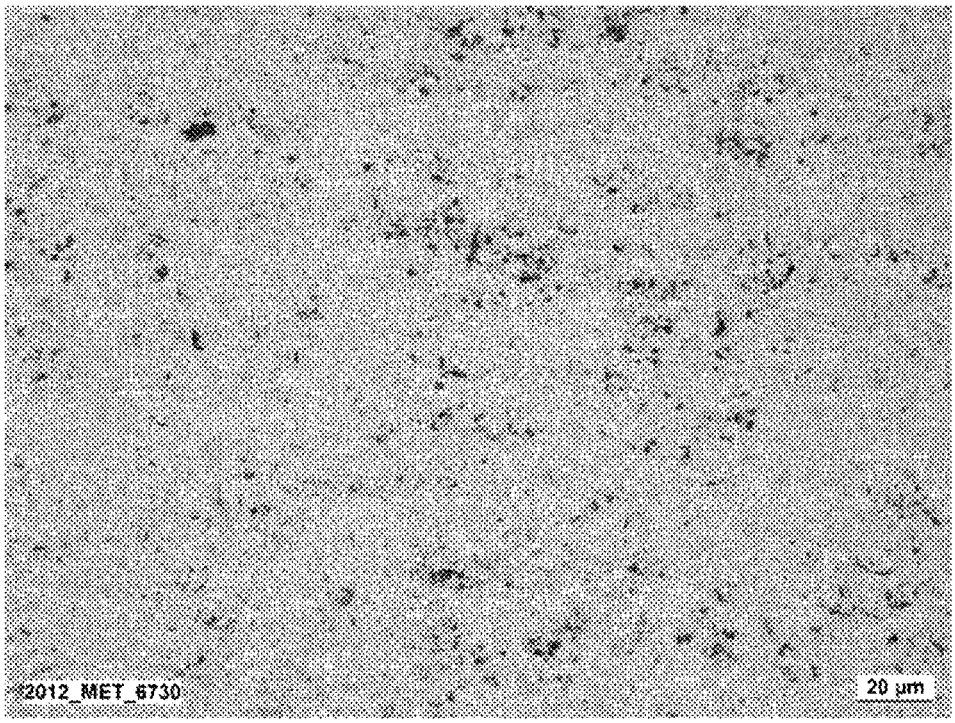
FIG. 2 shows an optical micrograph of a polished specimen of a sprayed layer according to the present invention.

FIG. 2 shows an optical micrograph of a polished specimen of a sprayed layer according to the present invention. The finely dispersed distribution of the dark-grey molybdenum carbide, a narrow web width of the light-grey metallic matrix, and an average particle size of the molybdenum carbide, which is optically significantly below 10 μm, can clearly be seen. The microstructure (texture) of the sprayed layer differs considerably in these points from microstructures of other systems known from the prior art (compare, for example, EP 0 701 005 B1, FIGS. 1 and [0011]).

Comparative Example

Commercial, agglomerated/sintered spray powders based on WC and chromium carbide were processed under the same spraying conditions as described above to give coatings, and the wear results in accordance with ASTM G65 were measured. For the purpose of comparability, the loss in mass was divided by the true density in order to be able to compare the volume wear rates directly. An industrial, electrolytic hard chromium coating was also included. The oxygen content of the layer after detachment was also measured.

The results are shown in Table 1, with Examples 1 to 3 and 5 being comparative examples, and Example 4 being an example according to the present invention. Apart from hard chromium, the materials in all examples are cermets having a high degree of dispersion of the hard materials in the metallic matrix.

TABLE 1

| | Examples | | | | |
|---|---|---|---|---|---|
| | 1 | 2 | 3 | 4 | 5 |
| Coating material [a] | WC—CoCr 86/10/4 | WC—Co 83/17 | CrC—NiCr 75/25 | $Mo_2C$—NiMo | Hard chromium |
| Pycnometric density of the spray powder | 13.9 | 13.9 | 7.33 | 9.02 | 6.9 [b] |
| ASTM G65 ($mm^3$) | 1.3-1.6 | 3.5 | 5-7 | 2.8 | 4.2 |
| Oxygen (% by weight) | 0.3-0.6 | 0.1-0.3 | 0.4-0.7 | 0.15 | about 1.0 |

[a] The numbers relate to the wt.-% of the hard materials and the metallic matrix
[b] Geometric density It can be seen that the two chromium-free agglomerated/sintered spray powders (Examples 2 and 4) produce self-cleaning sprayed layers and have similar wear rates due to the absence of Cr and thus of nonvolatile chromium oxide, although the sprayed layer composed of molybdenum carbide (Example 4) has the advantage of a lower density. Although the sprayed layer composed of chromium carbide has an even lower density, it has an unsatisfactory wear resistance.

Although the hardness of the sprayed layer according to the present invention is more in a range which is comparable with chromium carbide-based sprayed layers (700-900) than with tungsten carbide-based layers (1100-1300), the wear rate tends to be comparable with the latter, which is surprising in view of the hardness as a parameter which is expected to have the main influence on the wear.

The present invention is not limited to embodiments described herein; reference should be had to the appended claims.

What is claimed is:

1. A sintered spray powder comprising:

from 5 to 50 wt.-% of a metallic matrix, based on the total weight of the sintered spray powder, the metallic matrix comprising from 0 to 20 wt.-% of molybdenum, based on the total weight of the metallic matrix;

from 50 to 95 wt.-% of a hard material, based on the total weight of the sintered spray powder, the hard material comprising at least 70 wt.-% of molybdenum carbide based on the total weight of the hard material, an average particle diameter of the molybdenum carbide in the sintered spray powder being <10 μm, determined in accordance with ASTM E112;

0 to 10 wt.-% of a wear-modifying oxide, based on the total weight of the sintered spray powder; and boron in an amount of 0.001 to 1.4 wt.-%, based on the total weight of the metallic matrix.

2. The sintered spray powder as recited in claim 1, wherein the metallic matrix further comprises silicon in an amount of 0.001 to 2.4 wt.-%, based on the total weight of the metallic matrix.

3. The sintered spray powder as recited in claim 1, wherein the molybdenum carbide is at least one of MoC and $Mo_2C$.

4. The sintered spray powder as recited in claim 1, wherein the average particle diameter of the molybdenum carbide in the sintered spray powder is from 0.5 to 6.0 μm.

5. The sintered spray powder as recited in claim 1, wherein the hard material further comprises carbides selected from a titanium carbide, a zirconium carbide, a hafnium carbide, a vanadium carbide, a niobium carbide, a tantalum carbide, a chromium carbide, a molybdenum carbide, a tungsten carbide, and a boron carbide.

6. The sintered spray powder as recited in claim 1, wherein the sintered spray powder is agglomerated prior to being sintered.

7. The sintered spray powder as recited in claim 1, wherein the metallic matrix further comprises at least 60 wt.-% of a metal selected from iron, cobalt, and nickel, based on the total weight of the metallic matrix.

8. The sintered spray powder as recited in claim 1, wherein the metallic matrix further comprises less than 40 wt.-% of an elongation at break reducer and strengthening element based on the total weight of the metallic matrix.

9. The sintered spray powder as recited in claim 8, wherein the elongation at break reducer and strengthening element is selected from molybdenum, tungsten, boron, silicon, chromium, niobium, manganese, and mixtures thereof.

10. The sintered spray powder as recited in claim 1, wherein the metallic matrix further comprises nickel in an amount of from 50 to 95 wt.-%, based on the total weight of the metallic matrix.

11. The sintered spray powder as recited in claim 1, wherein the metallic matrix further comprises cobalt in an amount of from 10 to 90 wt.-%, based on the total weight of the metallic matrix.

12. The sintered spray powder as recited in claim 1, wherein the metallic matrix further comprises iron in an amount of from 10 to 90 wt.-%, based on the total weight of the metallic matrix.

13. The sintered spray powder as recited in claim 1, wherein the metallic matrix comprises molybdenum in an amount of from 2 to 15 wt.-%, based on the total weight of the metallic matrix.

14. The sintered spray powder as recited in claim 1, wherein the sintered spray powder comprises the wear-modifying oxides in an amount of from 1 to 8 wt.-%, based on the total weight of the sintered spray powder.

* * * * *